US006086658A

United States Patent [19]

Gohara et al.

[11] Patent Number: 6,086,658

[45] Date of Patent: Jul. 11, 2000

[54] METHOD AND APPARATUS FOR AIR SPARGED SLURRY TANKS

[75] Inventors: Wadie Fawzy Gohara, Barberton; Thomas Wayne Strock, Canton; John Ronald Cline, Akron, all of Ohio

[73] Assignee: McDermott Technology, Incorporated, New Orleans, La.

[21] Appl. No.: 09/366,844

[22] Filed: Aug. 4, 1999

Related U.S. Application Data

[63] Continuation of application No. 08/702,425, Aug. 14, 1996, Pat. No. 6,013,120.

[51] Int. Cl.[7] ..... B01F 3/04

[52] U.S. Cl. ..... 95/189; 96/228; 96/235; 134/169 C; 261/124; 261/DIG. 9

[58] Field of Search ..... 95/187–189; 261/124, 261/DIG. 9; 422/231; 96/228, 235; 134/22.11, 22.12, 22.18, 167 C, 168 C, 169 C

[56] References Cited

U.S. PATENT DOCUMENTS

| | | | |
|---|---|---|---|
| 1,940,199 | 12/1933 | Wagner | 96/27 |
| 2,403,545 | 7/1946 | Nutting | 261/19 |
| 2,576,843 | 11/1951 | Lockman | 134/22.12 X |
| 3,260,036 | 7/1966 | De Bellis | 96/280 |
| 4,515,754 | 5/1985 | Stehning | 261/DIG. 9 |
| 4,799,941 | 1/1989 | Westermark | 261/151 X |
| 5,122,312 | 6/1992 | Tomalesky | 261/124 X |
| 5,169,567 | 12/1992 | Daugherty et al. | 261/124 X |
| 5,378,355 | 1/1995 | Winkler | 134/22.12 X |
| 5,470,149 | 11/1995 | Witkowski et al. | 261/124 X |
| 5,494,614 | 2/1996 | Gohara et al. | 261/124 |
| 5,540,760 | 7/1996 | Risse et al. | 95/195 |
| 6,013,120 | 1/2000 | Gohara et al. | 96/228 |

*Primary Examiner*—Richard L. Chiesa
*Attorney, Agent, or Firm*—Robert J. Edwards; D. Neil LaHaye

[57] ABSTRACT

A method and device for using the density control water to continuously flush the oxidation air header and the sparge pipes in a flue gas wet scrubber agitation tank. The density control line is routed to the elevation where the control valve is located. A U-shaped trap is located between the control valve and air sparge header such that the density control water joins the humidified oxidation air. A liquid layer forms on the floor of the header and is moved toward the distant side of the header by the motion of the air passing on top of the liquid layer and by the continuous flow of water. The bottom section of the main header is perforated to allow the flowing water to exit the header into the tank and flush any accumulated solids that might penetrate the header through the air holes. The air holes are located in a section at a minimum of five degrees off the floor and maximum of one hundred eighty degrees off the header bottom and preferably at forty-five degrees. The distant end of the header has an opening located close to the header floor to provide an outlet for the flushed solids and prevents the formation of back waves in the header.

4 Claims, 1 Drawing Sheet

METHOD AND APPARATUS FOR AIR SPARGED SLURRY TANKS

This application is a continuation of the U.S. application filed on Aug. 14, 1996 and assigned Ser. No. 08/702,425, and now U.S. Pat. No. 6,013,120.

BACKGROUND OF THE INVENTION

1. Field of the Invention

The invention is generally related to the removal of sulfur-containing compounds from flue gases, and more particularly to the use of air sparging for the oxidation and/or mixing and suspension of such compounds.

2. General Background

Industrial combustion systems, such as power plant boiler combustion chambers, that use high sulfur fuels tend to release sulfur-containing compounds such as sulfur dioxide and sulfur trioxide into the flue gases. Due to the detrimental effects of such compounds, it is necessary to prevent their release into the surrounding environment. Wet scrubbers for the desulfurization of flue gases treat the flue gas in a scrubbing tower with a scrubbing solution which may contain substances capable of binding the sulfur compounds. A reaction tank or recirculation tank at the bottom of the tower is used to collect the scrubbing solution, sulfur compounds removed from the flue gases, and any particulates scrubbed from the flue gases. The volume of the tank permits several chemical and physical processes to approach completion. Air sparging is an economical and simple means of providing oxidation air and mixing to a flue gas desulfurization system. The advantages of air sparging include low capital cost, control of the size of the air bubbles, even distribution of the air in the tank, and violent mixing between the air and the tank contents. A drawback of this method is the back flow of slurry into the sparge pipes and the potential blockage of the sparge pipe holes if the air flow is interrupted. Other systems include introducing the air in front of a rotating mixer to break the air bubbles, or introducing the air through the mixer shaft, which requires additional power to operate the mixers. In such systems, the loss of a mixer affects the capacity of the system to achieve oxidation unless a spare mixer is provided. Patents in this general area of technology that applicants are aware of include the following.

U.S. Pat. No. 4,515,754 to Stehning discloses a back wash means to circulate solids from the tank and mix them back in another elevation of the same tank. The function of back wash is to keep the solids in the tank mixed and in suspension.

U.S. Pat. No. 3,260,036 to DeBellis discloses a U-shaped trap to maintain a minimum liquid level in the tank equal to less than the height of the U bend.

U.S. Pat. No. 4,799,941 to Westermark discloses a method for condensing flue gases in combustion plants.

U.S. Pat. No. 1,940,199 to Wagner discloses a dust extractor wherein an inverted U-shaped trap is used to maintain a liquid level in the extractor when a drain valve is closed.

U.S. Pat. No. 2,403,545 to Nutting discloses a liquid level control apparatus for a dust collector wherein water is set by the hydraulic interaction of the air and water.

The existing art does not adequately address the slurry infiltration problem encountered in the reaction tank.

SUMMARY OF THE INVENTION

The invention addresses the above need. What is provided is a means of using the density control water to continuously flush the oxidation air header and the sparge pipes. The density control line is routed to the elevation where the control valve is located. A U-shaped trap is located on the downstream side of the control valve to cause the density control water to form a trap seal. The water pressure is set to be equal to or up to four pounds lower than the air pressure but not less than the liquid back pressure in the tank. The opposite end of the trap is connected to the side of the main oxidation air header where the density control water joins the humidified oxidation air. A liquid layer forms on the floor of the header and is moved toward the distant side of the header by the motion of the air passing on top of the liquid layer and by the continuous flow of water. The bottom section of the main header is perforated to allow the flowing water to exit the header into the tank and flush any accumulated solids that might penetrate the header through any idle air holes. The air holes are located in a section at a minimum of five degrees off the bottom of the header pipe and maximum of one hundred eighty degrees off the header bottom. The distant end of the header has an opening located close to the header floor to provide an outlet for the flushed solids and prevents the formation of back waves in the end section of the header.

BRIEF DESCRIPTION OF THE DRAWINGS

For a further understanding of the nature and objects of the present invention reference should be had to the following description, taken in conjunction with the accompanying drawings in which like parts are given like reference numerals, and wherein.

DETAILED DESCRIPTION OF THE PREFERRED EMBODIMENT

Figure 1:
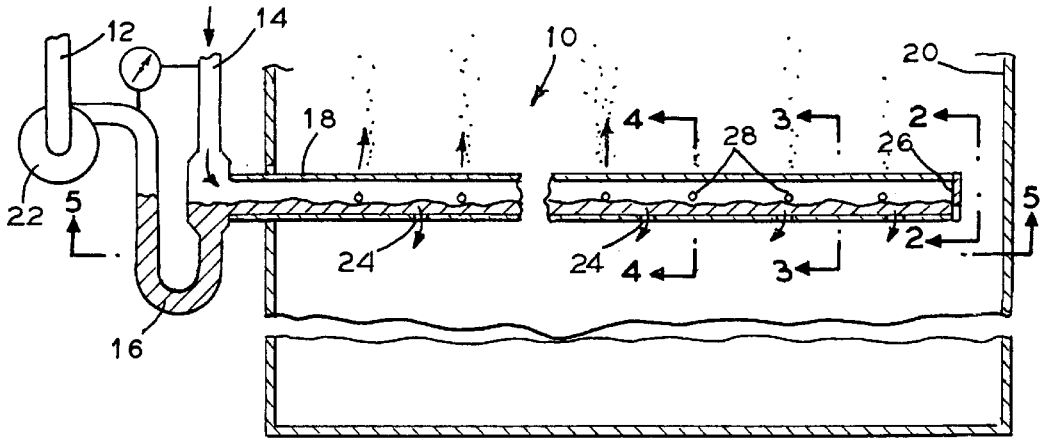
FIG. 1 is a side view of the invention.

Referring to the drawings, it is seen in FIG. 1 that the invention is generally indicated by the numeral 10. Air sparge apparatus 10 is generally comprised of liquid line 12, air line 14, pressure trap 16, and air sparge header 18.

Liquid line 12 comprises the density control line that is normally used to direct density control liquid into the agitation tank 20. However, in the present invention, the density control line 12 is directed to an elevation where the control valve 22 is located approximately at the same level as the sparge air header 18.

U-shaped trap 16 is connected at one end to the end of density control line 12 downstream of the control valve 22 and at the opposite end to sparge air header 18 so as to be in fluid communication between the line 12 and header 18. U-shaped trap 16 thus forms a pressure trap between the line 12 and header 18.

Figure 5B:
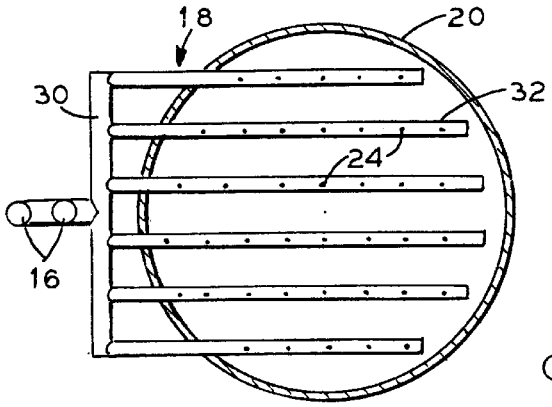
FIG. 5B is a view taken along lines 5—5 in FIG. 1.

Sparge air header 18 receives oxidation air via air line 14, which is in fluid communication with header 18 substantially above the junction of U-shaped trap 16 and header 18. FIG. 5B illustrates the preferred embodiment of the invention where air sparge header 18 comprises a manifold 30 in fluid communication with a plurality of air sparge pipes 32 across the length of the manifold. The air sparge pipes 32 extend from the manifold 30 into and across the radius of the agitation tank 20. Sparge air header 18 is provided with a plurality of bores 24, 26, and 28.

Figure 3:
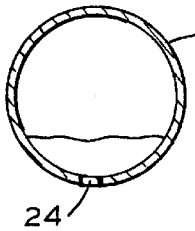
FIG. 3 is a view taken along lines 3—3 in FIG. 1.
Figure 2:
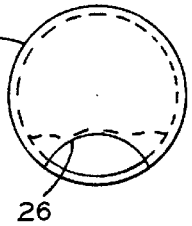
FIG. 2 is a view taken along lines 2—2 in FIG. 1.

Bores 24, seen in FIGS. 1, 3, and 5, are positioned along the bottom of the header to allow the flowing liquid to exit the header into the tank 20 and flush any accumulated solids that might enter the header through the air holes.

As best seen in FIG. 1, bore 26 is preferably located at a position on the header that is distant from air line 14 and pressure trap 16. Bore 26 is preferably positioned at or near the floor of the header 18 such that the liquid may exit the header without forming back waves in the header. Bore 26 is also large enough to serve as an outlet for solids being flushed from the header.

Figure 4B:
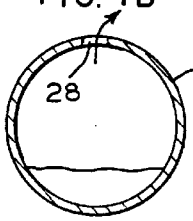
FIG. 4B is an alternate embodiment of the view taken along lines 4—4 in FIG. 1.
Figure 4A:
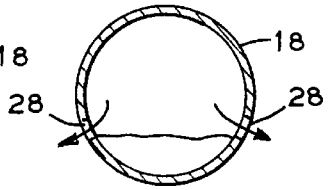
FIG. 4A is a view taken along lines 4—4 in FIG. 1.

Oxidation air exit bores 28, seen in FIGS. 1 and 4A, are preferably located at a minimum of five degrees off the floor of the header and preferably at forty-five degrees. FIG. 4B illustrates an alternate embodiment where the air exit bores 28 may be positioned at the top of the header.

Figure 5A:
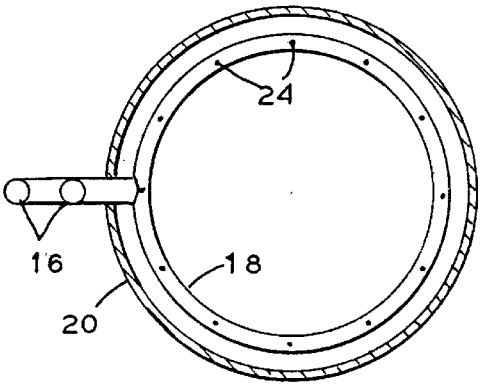
FIG. 5A is an alternate embodiment of the view taken along lines 5—5 in FIG. 1.

FIG. 5A illustrates an alternate embodiment wherein sparge air header 18 is circular. Sparge air header 18 is provided with bores for the exit of density control liquid and oxidation air as described for the preferred embodiment of FIGS. 1 and 5B.

In operation, the pressure of the density control liquid is set to be equal to or four pounds less than the oxidation air pressure in oxidation line 14 at the junction with the air sparge header 18. U-shaped pressure trap 16 fulfills three functions. The first is to provide adequate water height to equalize the difference in pressure between the water supply and the oxidation air header 18. The second is to dampen changes in the oxidation air header pressure. The third is to allow the water to be entrained and carried by the oxidation air, forming waves ahead of the horizontal run of the header 18. Liquid and air separation may occur as the mixture reaches the horizontal section of the oxidation air header 18. A liquid layer forms on the floor of the header and is moved towards the distant side of the header by the motion of the air passing on top of the liquid layer and by the continuous flow of water. The liquid exit bores 24 allow any accumulated solids that penetrate the header through the air exit bores 28 to be flushed out of the header. Bore 26 is preferably an eccentric opening located close to the header floor and functions to provide an outlet for the flushed solids and also prevents the formation of back waves in the end section of the header.

A number of advantages are provided by the arrangement of the invention. The header is kept clean by continuous flushing. Inclusion of the density control water for header flushing provides adequate back pressure for proper operation of the control valve without the need for additional piping. The U-shaped trap and the density control water trapped therein dampens the effect of changes in pressure between the water and air lines. The liquid trap equalizes the differential pressure between the water and air legs, which results in a lack of equal pressure between the two streams not being critical, and also minimizes interruption of the low pressure flow. Air and water mixing ahead of the horizontal air header section insures complete humidification of air and possibly allows entrainment of small droplets of water in the air stream, thus minimizing the potential of solids build up on the perimeter of bores 28. The horizontal section of the header allows the separation of the two phases, allowing the liquid phase to scrub the floor of the header. The waves created in the liquid by the air increases the liquid velocity in the header and promotes motion of any solids deposited on the floor of the header. The positive air pressure above the liquid in the header enhances motion of the solids to exit through the bottom holes in the header.

Because many varying and differing embodiments may be made within the scope of the inventive concept herein taught and because many modifications may be made in the embodiment herein detailed in accordance with the descriptive requirement of the law, it is to be understood that the details herein are to be interpreted as illustrative and not in a limiting sense.

What is claimed as invention is:

1. In a flue gas desulfurization apparatus having an agitation tank, an improved air sparge apparatus, comprising:

a. a sparge air header, in communication with an air line, having a plurality of bores along the length of the header;

b. a liquid line at an elevation approximately the same level as said sparge air header; and c. fluid communication means between said sparge air header and said liquid line such that liquid in said liquid line is directed into said sparge air header, whereby both liquid and air are simultaneously and continuously directed into said sparge air header to prevent backflow of solid material from the tank into the sparge air header.

2. The air sparge apparatus of claim 1, wherein said fluid communication means comprises a U-shaped trap.

3. The air sparge apparatus of claim 1, wherein said sparge air header comprises a manifold having a plurality of air sparge pipes in fluid communication therewith.

4. A method for using density control water to continuously flush the oxidation air header and sparge pipe in a flue gas wet scrubber agitation tank, comprising:

a. providing a density control liquid line at approximately the same level as the oxidation air header and sparge pipe;

b. providing fluid communication between said liquid line and the oxidation air header such that liquid in said liquid line is directed into the oxidation air header simultaneously and continuously with the air; and c. setting the pressure in the density control liquid line to be equal to or slightly less than the air pressure in the oxidation air header to allow the air pressure to drive the density control fluid through the sparge air header holes and prevent solid material in the tank from entering the header.

* * * * *